US006053155A

United States Patent [19]

Kashima

[11] Patent Number: 6,053,155

[45] Date of Patent: Apr. 25, 2000

[54] IGNITION MOUNTING ARRANGEMENT FOR OUTBOARD MOTOR

[75] Inventor: Yukinori Kashima, Hamamatsu, Japan

[73] Assignee: Sanshin Kogyo Kabushiki Kaisha, Japan

[21] Appl. No.: 09/008,932

[22] Filed: Jan. 20, 1998

[30] Foreign Application Priority Data

Jan. 20, 1997 [JP] Japan ..... 9-019583

[51] Int. Cl.[7] ..... F02P 1/00

[52] U.S. Cl. ..... 123/599; 123/406.56; 123/196 W

[58] Field of Search ..... 123/647, 635, 123/599, 196 W, 406.57, 406.56, 406.74; 440/77, 78, 88, 900

[56] References Cited

U.S. PATENT DOCUMENTS

| | | | |
|---|---|---|---|
| 3,955,550 | 5/1976 | Carlsson | 123/599 |
| 4,325,350 | 4/1982 | Bauer et al. | 123/599 |
| 4,606,314 | 8/1986 | Yamazaki | 123/406.74 |
| 4,907,561 | 3/1990 | Kandler | 123/599 |
| 5,159,916 | 11/1992 | Isogawa | 123/406.56 |
| 5,524,597 | 6/1996 | Hiki et al. | 123/635 |
| 5,553,586 | 9/1996 | Koishikawa et al. | 123/196 W |

*Primary Examiner*—Willis R. Wolfe
*Assistant Examiner*—Hieu T. Vo
*Attorney, Agent, or Firm*—Knobbe, Martens, Olson & Bear, LLP

[57] ABSTRACT

An ignition arrangement for an internal combustion engine having an output shaft supported for rotation about an axis. The engine includes an engine housing at least partially enclosing the output shaft. Oil seals at least partially surround the output shaft for sealing the output shaft to the engine housing. An oil seal housing at least partially surrounds the output shaft and at least partially engages the oil seals. The oil seal housing directly supports a first ignition component.

8 Claims, 7 Drawing Sheets

IGNITION MOUNTING ARRANGEMENT FOR OUTBOARD MOTOR

BACKGROUND OF THE INVENTION

This invention relates to an ignition timing control arrangement for an outboard motor with an internal combustion engine and more particularly to an improved arrangement for mounting the ignition system.

It is well known, in connection with certain types of engines, to provide a flywheel magneto in which the flywheel carries a plurality of rotating magnets and which cooperates with a charging coil and a pulser coil for charging and firing an ignition circuit. In accordance with such arrangements, it is frequently the practice to mount the pulser coil on a plate that so that it can detect and signal the position of the crankshaft in order for proper timing of the ignition of the engine.

To minimize cost, however, it is a common desire to minimize the number of parts required to build an outboard motor. Minimizing the total number of parts results in many benefits to the manufacturer. For instance, the total mass of the engine will be lower. Also, the cost to build the motor will be lower for several reasons. First, the material cost of the eliminated part is not included in the total cost of the production of the engine. Second, an engine with a fewer number of parts will typically cost less to assembly that an engine with a greater number of parts. Third, a greater number of parts requires greater inventory supplies which in turn add to the cost of the engine.

A need therefore exists to produce an engine with a lesser number of total parts.

Another problem associated with the prior design is that when a design incorporates more parts it is typically of a greater vertical height than a design with a lesser number of parts. There are several problems associated with an engine with a large vertical height. First, a large vertical engine will require a larger cowling which will typically cost more to produce because of the greater amount of material. Second, the larger engine will have a greater profile which will cause wind resistance thereby increasing the aerodynamic drag and decreasing the efficiency of the watercraft.

A need therefore exists to minimize the vertical profile of the motor.

It is therefore, a principal object of this invention to provide an improved mounting arrangement for the ignition system of the engine. More specifically it is an object of the invention to provide an arrangement of the ignition system of the engine that will minimize the number of parts required to produce the engine.

It is a further object of this invention to provide a mounting structure for the ignition system of the engine to facilitate a system that will minimize the overall engine height.

SUMMARY OF THE INVENTION

One aspect of the invention is an improved ignition arrangement for an outboard motor. The outboard motor is of the internal combustion engine variety with an output shaft supported for rotation about an axis. The motor also includes an engine housing at least partially enclosing the output shaft. Oil seals at least partially surround the output shaft for sealing the output shaft to the engine housing. An oil seal housing at least partially surrounds the output shaft and at least partially engages the oil seals. The oil seal housing directly supports a first ignition component.

Another aspect of the invention is an ignition arrangement for an internal combustion engine having an output shaft supported for rotation about an axis. An engine housing at least partially encloses said output shaft. The oil seals at least partially surrounding the output shaft for sealing the output shaft to the engine housing. An oil seal housing at least partially surrounds the output shaft and at least partially engages the oil seals and is mounted to the engine housing. The oil seal housing includes a portion extending into the engine housing in the vicinity of the oil seals and the oil seal housing directly supports a first ignition component.

Still another aspect of the invention is an ignition arrangement for an internal combustion engine having an output shaft supported for rotation about an axis. An engine housing at least partially encloses the output shaft. The oil seals at least partially surround the output shaft for sealing the output shaft to the engine housing. An oil seal housing at least partially surrounds the output shaft and at least partially engages the oil seals. The oil seal housing at least partially journals a pulser coil mounting member on a side of the oil seal housing opposite the oil seals.

DETAILED DESCRIPTION OF THE PREFERRED EMBODIMENTS OF THE INVENTION

Figure 1:
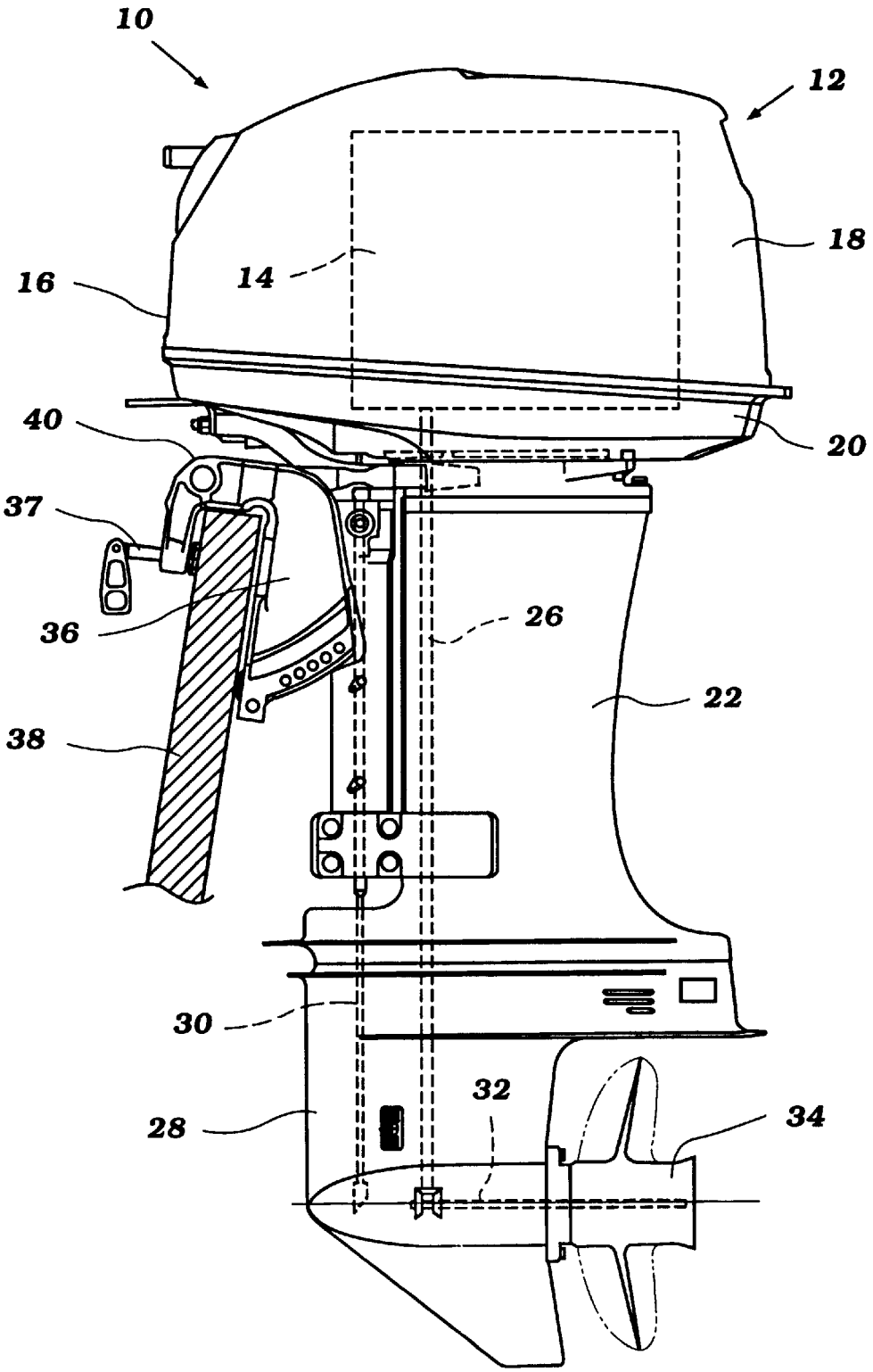
FIG. 1 is a side elevational view of an outboard motor with some parts shown in phantom having an ignition system constructed in accordance with an embodiment of the invention and a partial view of an associated watercraft.

FIG. 1 shows an outboard motor constructed in accordance with an embodiment of this invention and is identified generally by the reference numeral 10. The outboard motor 10 is generally comprised of a powerhead 12. The powerhead 12 is comprised of a powering internal combustion engine generally referenced by the number 14. In this embodiment, the engine 14 is a two stroke engine. As will become apparent by description of the remaining embodiments, the invention is not limited to the number of cylinders employed or the cylinder orientation. In addition, the invention is not limited to reciprocating engines or engines operating on the two stroke crankcase compression principal. Because the invention particularly relates to two cycle engines this type of embodiment is depicted.

In addition to the engine 14, the powerhead 12 is comprised of a protective cowling arrangement referenced generally by the numeral 16. The cowling arrangement 16 is divided into an upper portion 18 and a lower portion 20. The upper cowling portion 18, which generally has an inverted cup shape and which is typically formed from a molded fiberglass reinforced resin, is detachably connected to the lower cowling portion 20 by means such as a latch assembly as known in the art. The latch assembly, not shown, facilitates the removal of the upper cowling portion 18 for servicing of the engine 14.

The cowling 16 generally surrounds and protects the engine 14 from the environment. The engine 14 is typically mounted on tray which is not shown. The tray is typically formed from a rigid material such as aluminum or a molded fiberglass resin. The tray is typically affixed to the upper end of the drive shaft housing 22.

The engine 14 has crankshaft or output shaft 24 (shown in FIG. 2) which is generally vertically disposed. The output shaft 24 preferably drives a drive shaft 26 that extends through a drive shaft housing 22 and into a lower unit 28. The current embodiment depicts a configuration where the drive shaft housing 22 and lower unit 28 are two distinct pieces, however, it is understood that the drive shaft housing 22 can be formed integrally with the lower unit 28.

The drive shaft 26 selectively communicates with a suitable forward/neutral/reverse transmission. The position of the transmission is selected by the operator of the watercraft and is transferred to the transmission through the shift rod 30. The shift rod 30, in turn, is connected to transmission linkage (not shown) to move the transmission into a forward, neutral or reverse position.

When the transmission is in a drive position, either forward or reverse, the drive shaft 26 drives the propulsion shaft 32 which in turn drives the propulsion means. The propulsion means can be a waterjet propulsion system, or, as shown in the current embodiment, a propeller 34.

Still referring to FIG. 1, a clamping bracket 36 is adapted to be affixed by clamping with the clamping screw 37 to the transom 38 of the associated watercraft. The clamping bracket 36 pivotally supports a swivel bracket 40 for tilt and trim movements. The swivel bracket 40, in turn, rotatably supports a steering shaft (not shown) for steering movement about a generally vertically extending steering axis. The steering shaft, in turn, is resiliently connected to the drive shaft housing 22.

Figure 2:
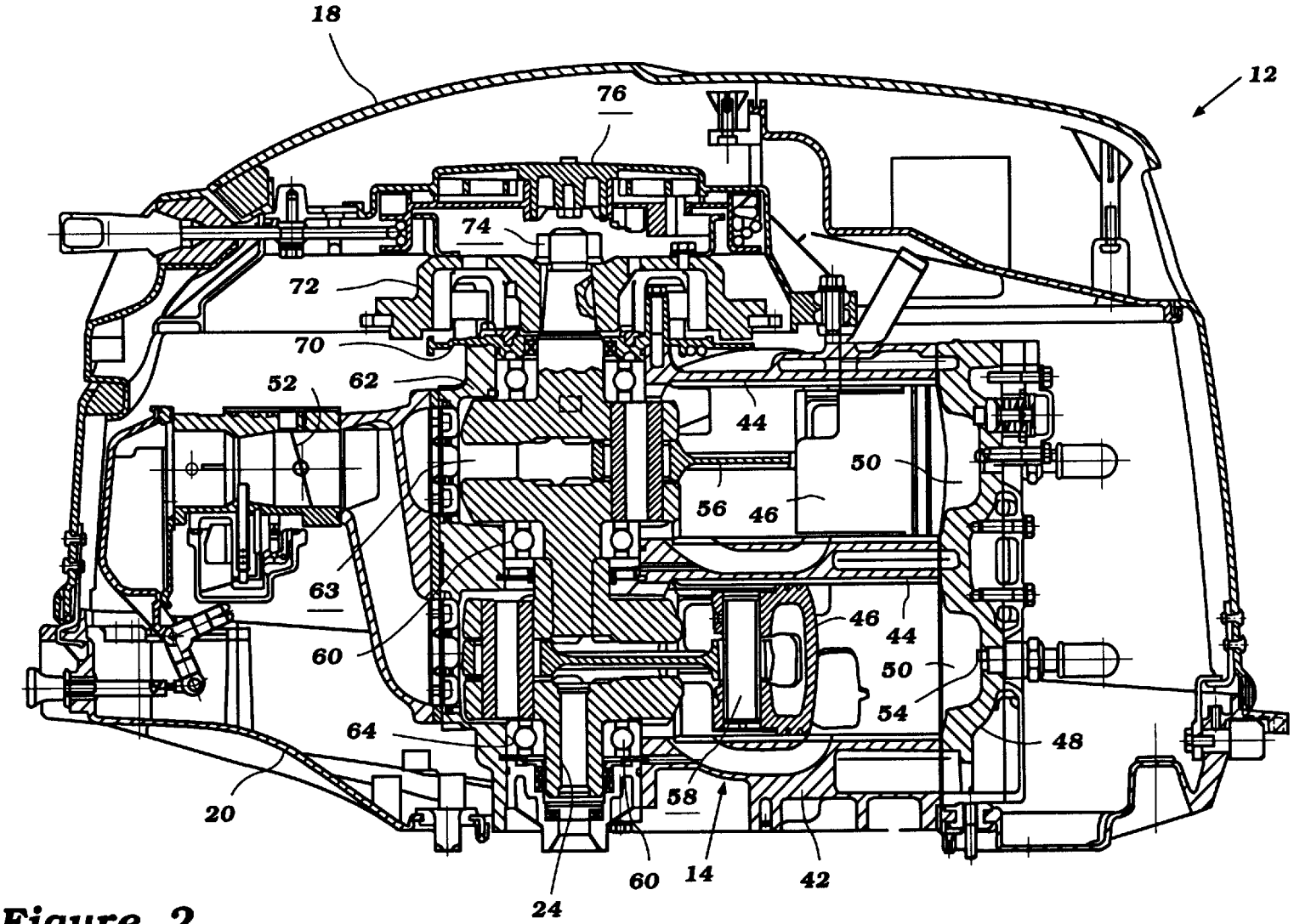
FIG. 2 is a partial cross-sectional side view of the outboard motor of FIG. 1 showing the arrangement of the ignition system in accordance with an embodiment of the invention.

The engine 14 includes a cylinder block 42 in which one or more cylinders 44 are disposed as illustrated in FIG. 2. As mentioned previously, the engine 14 may contain any number of cylinders and because the cylinders will typically be identical they will be described in the singular form. This method of description in no way limits the invention to an engine with only one cylinder.

The cylinder 44 journals the piston 46 which is designed to reciprocate therein. A cylinder head 48 is attached to the cylinder block 42 and thereby closes the respective cylinder bore 44. The shape of side of the cylinder head assembly adjacent to the piston 46 is preferably shaped to create a combustion chamber 50. Thus, the combustion chamber 50 is defined by the cylinder head 48, the piston 46 and the cylinder 44.

A throttle valve assembly 52 is controlled by the operator of the watercraft and allows the proper fuel and air charge to enter the combustion chamber 50 as is known in the art. A spark plug 54 ignites the fuel and air charge at a predetermined time through an ignition system. The ignition system is described more fully below.

The piston 46 is connected to a connecting rod 56 with a gudgeon pin 58 as is known in the art. The connecting rod 56 is connected to the crankshaft 24 on an opposite end. The crankshaft 24 is rotatably mounted within the engine 14. Preferably, a plurality of bearings 60 rotatably support the crankshaft 24. The bearings 60 lie between the cylinder block 42 and a crankcase member 62. The crankcase member 62 is attached to the cylinder block 42 and creates a crankcase chamber 63 in which the crankshaft 24 rotates. The crankcase chamber 63 contains engine oil for the lubrication of the engine components and is pressurized during operation as is known with two cycle crankcase compression engine technology.

The output shaft 24 extends through a opening 64 and out of the engine housing defined by the cylinder block 42 and the crankcase member 62. The output shaft 24 also extends out of the engine housing on the top side of the engine 14 through an opening 66. Oil seal means 68, best illustrated in FIG. 3, at least partially journal the output shaft 24 and prevent oil from exiting the crankcase chamber 63. The oil seal means 68 is at engaged by the oil seal housing 70. The oil seal housing 70 is attached to the engine 14 and extends at least partially into the opening 66 thereby trapping the oil seal 68 and the bearing 60.

A flywheel 72 is located above the oil seal housing 70 on the output shaft 24. The flywheel 72 is secured to the output shaft 24 with a nut 74 which mates with a threaded portion on the output shaft 24. A starter case 76 is located above the flywheel 72.

Figure 3:
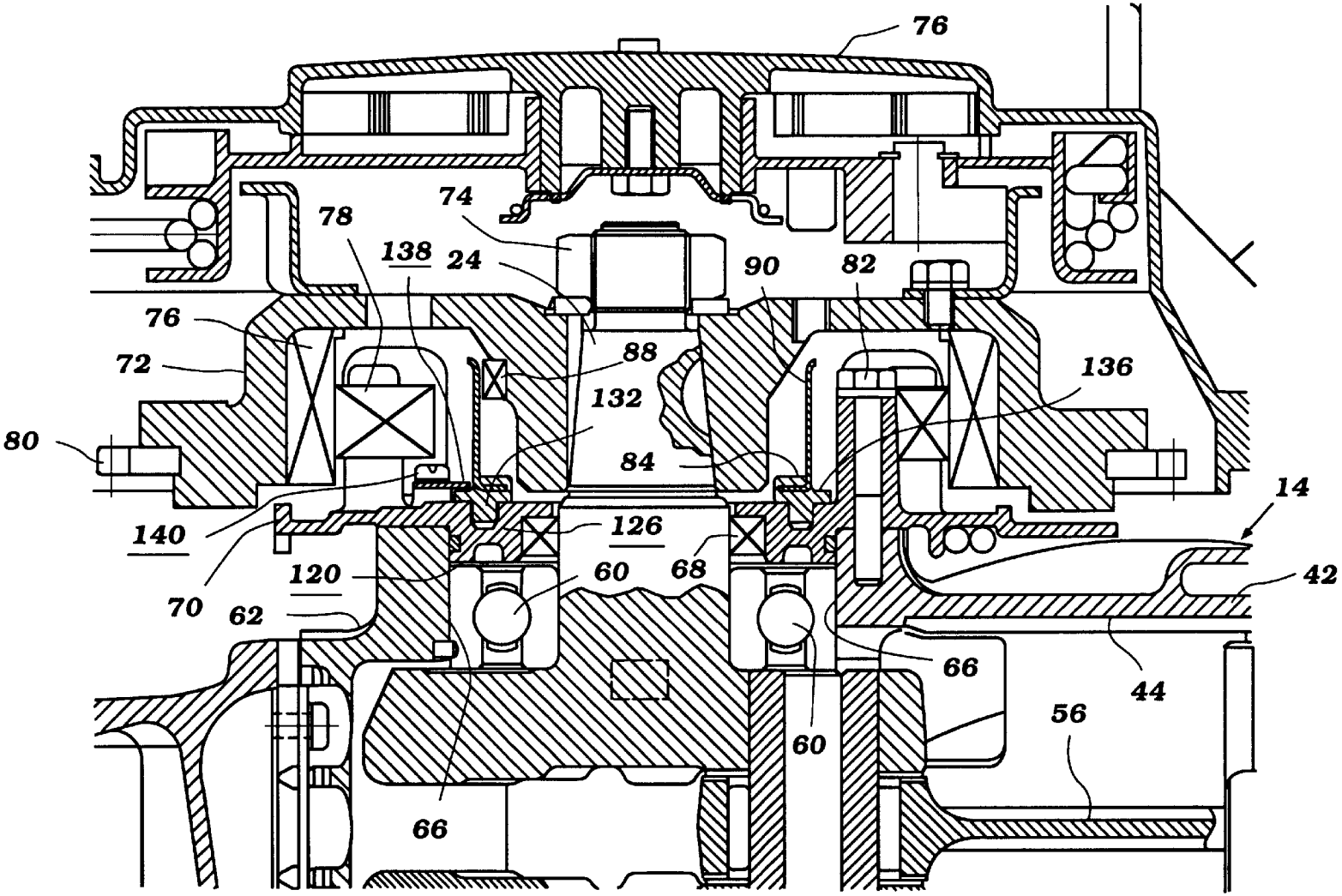
FIG. 3 is an enlarged partial cross-sectional side view of the outboard motor of FIG. 1 showing the arrangement of the ignition system in accordance with an embodiment of the invention.
Figure 4:
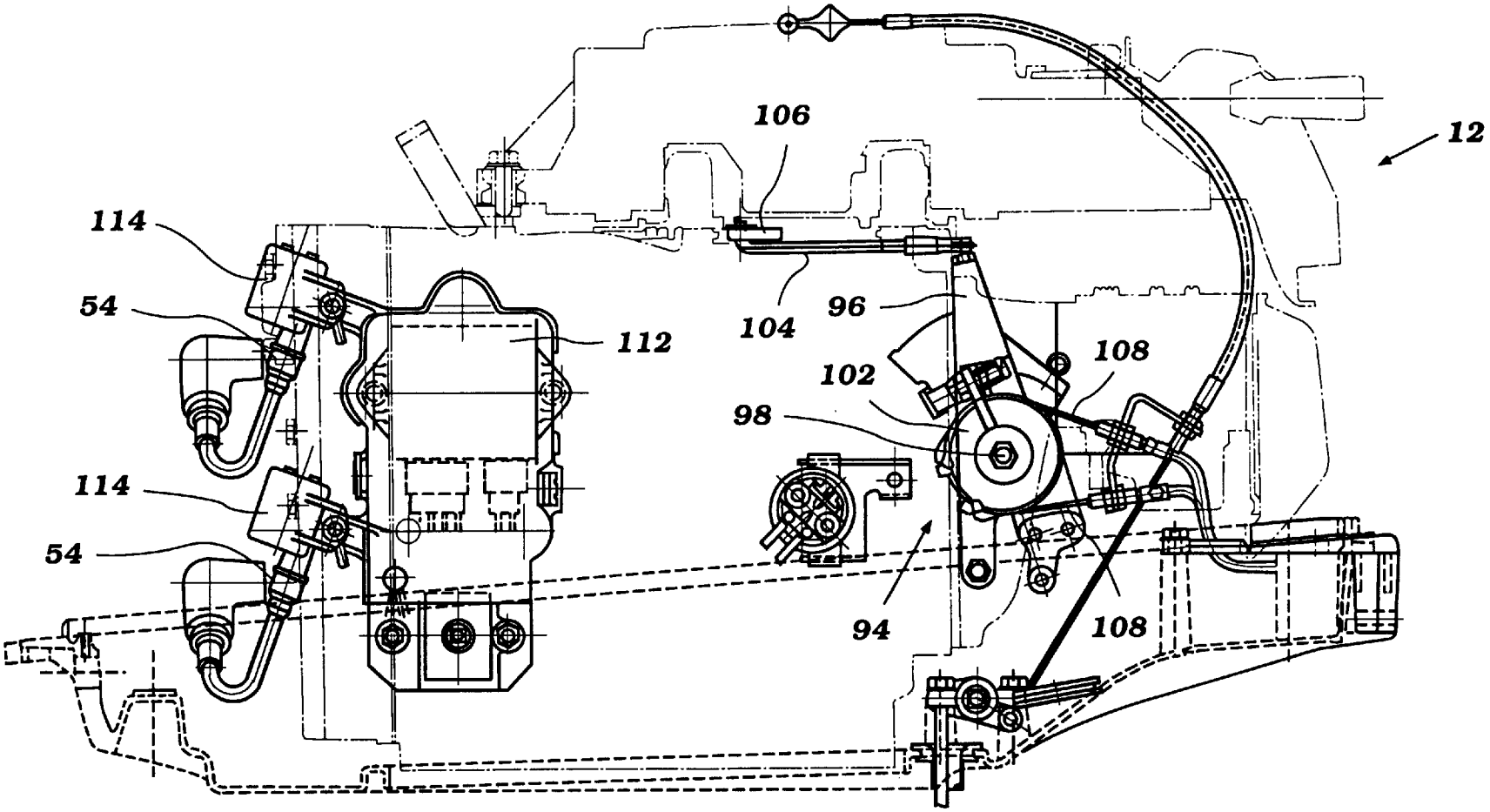
FIG. 4 is a partial side view of the outboard motor of FIG. 1 with ignition components shown in solid lines and portions of the outboard motor shown in phantom lines.
Figure 5:
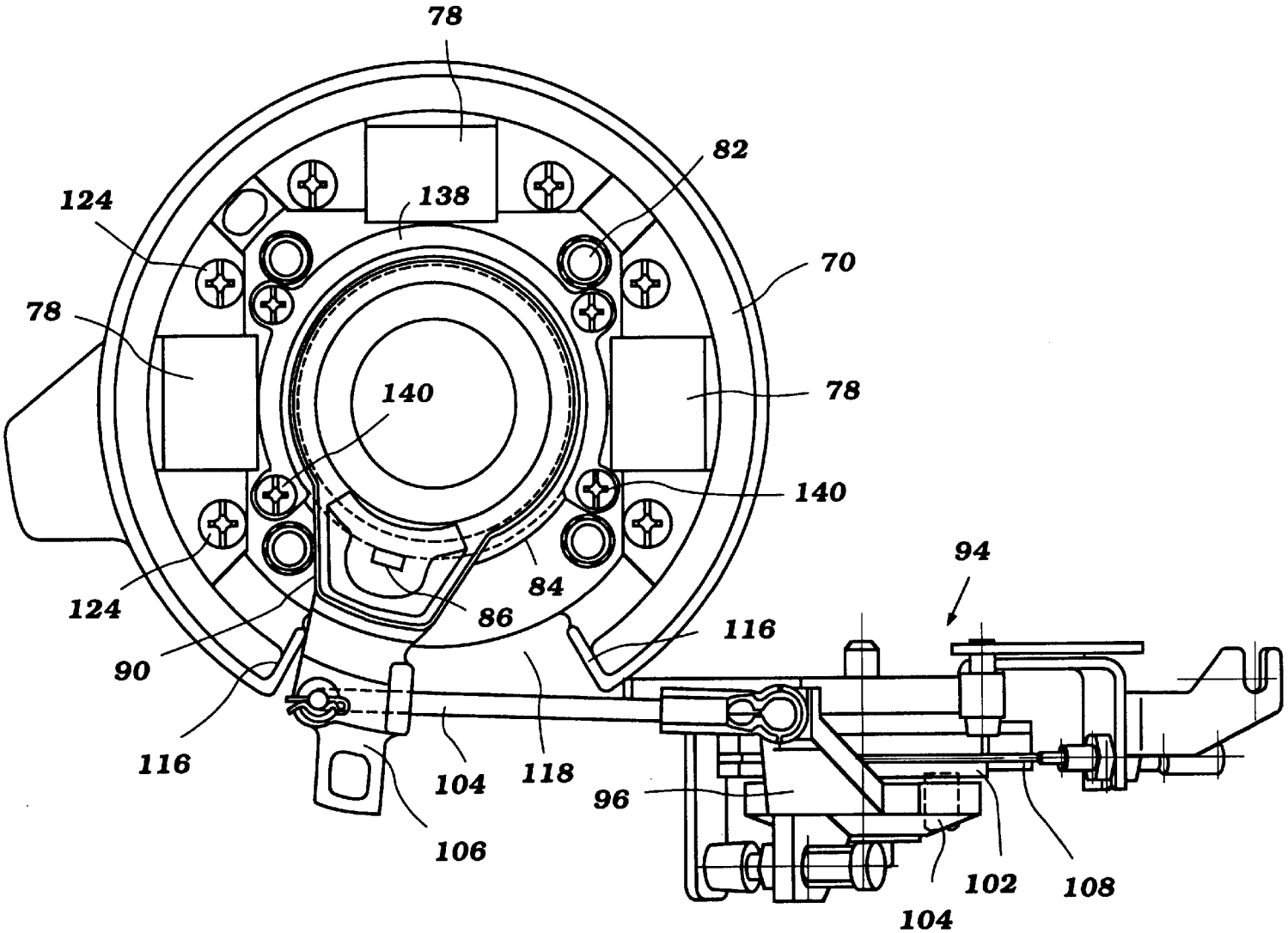
FIG. 5 is a plan view of the ignition mounting arrangement in accordance with an embodiment of the invention.

The engine ignition system is best illustrated in FIG. 3, FIG. 4 and FIG. 5. The ignition system is comprised of a flywheel magneto assembly in which the flywheel 72 carries a plurality of rotating magnets 76 which cooperate with at least one charging coil 78 and a pulser coil for charging and firing an ignition circuit.

The flywheel magneto assembly carries a peripheral ring gear 80 that may be engaged by a pinion gear (not shown) of a starter motor for electric starting of the engine 14 in any well known manner.

As stated above, the interior of the flywheel magneto 72 carries a series of circumferentialy segmented permanent magnets 76. These permanent magnets 76 cooperate with charging coils 78 that are affixed to the oil seal housing 70. The oil seal housing 70 is attached to the cylinder block 42 by threaded fasteners 82.

The coils 78 are connected to a suitable ignition circuit for charging, for example, a capacitor if a capacitor discharge ignition circuit is employed. In addition, the charging coils 78 may be employed for providing electrical power to charge a battery and/or to power various accessories of the engine 14 and the watercraft with which it is associated. As is well known, rotation of the flywheel 72 and the magnets 76 will induce a current in the coils 78 for this purpose.

A pulser coil mounting member 84 is mounted for rotation on a top side of the oil seal housing 70. The pulser coil 86 is mounted on the pulser coil mounting member 84 as best seen in FIG. 5. The pulser coil 86 cooperates with a magnet 88 located on the inside of the flywheel 72 and indicates the angular position of the output shaft 24 to an ignition circuit to be described below.

A shield 90 is attached to the pulser coil mounting member 84 and at least partially encircles the inner hub of the flywheel 72. The shield 90 can either be separately attached to the mounting member 84 or it can be integrally formed with the mounting member 84. The purpose of the shield 90 is to prevent inadvertent communication of the pulser coil 86 with the magnet 88.

The spark timing of the ignition system can be mechanically advanced by rotating the pulser coil mounting member 84 on the oil seal housing 70 as will be described. This operation is controlled by the control mechanism 94 as illustrated in FIG. 4 and FIG. 5. A spark timing lever 96 is journalled-on the pivot shaft 98. The pivot shaft 98 is journalled by throttle pulley 102. The throttle pulley 102 preferably includes a peg 104 protruding from the face the throttle pulley 102 and into a groove in lever 96. The peg 104 can travel freely throughout the groove until it is adjacent the end of the groove. Any further translation of the throttle pulley 102 will also move lever 96. Lever 96 is connected to a link 104 which is in turn pivotally connected to a lever portion 106 of the pulser mounting member 84.

Thus, when the operator of the associated watercraft actuates the throttle lever (not shown) the movement is translated into linear movement of throttle cable 108 which in turn rotates the throttle pulley 102. The throttle pulley 102 then, if moved far enough, will rotate lever 96 which in turn rotates pulser mounting member 84 through link 104. The movement of the pulser mounting member 84 will move pulser coil 86 thereby mechanically advancing the spark timing.

FIG. 4 also illustrates the general components of the spark control system. The spark control system includes a CDI unit 112. The CDI unit 112 provides an output signal to the ignition coils 114 which in turn fire the spark plugs 54. The pulser coil 86 also outputs a signal to the CDI unit 112. The timing of the signal of the pulser coil 86 will depend upon the angular position of the pulser mounting plate 84. The CDI unit 112 will preferably take the input from the pulser coil 86, which reads output shaft position, and compare that signal to a preprogrammed ignition timing map to determine the proper firing time of the spark plug 54 as is known in the art.

As illustrated in FIG. 5, the lever arm 106 of the pulser mounting member 84 is free to move between the stops 116 within the slot 118 provided in the oil seal housing 70. As previously discussed this allows the timing of the ignition to be altered.

FIG. 5 through FIG. 9 illustrate the layout of the individual components of the ignition system. As best illustrated in FIG. 3 and FIG. 5 the oil seal housing 70 is connected to the engine 14 with threaded fasteners 82 which pass through through-holes 119 in the oil seal housing 70. The oil seal housing 70 contains an extension portion 120 which is adjacent to the bearing 60 and the oil seal means 68 as best illustrated in FIG. 3. Further, the extension portion 120 contains a shoulder which engages and secures the position of the oil seal means 68.

Figure 7:
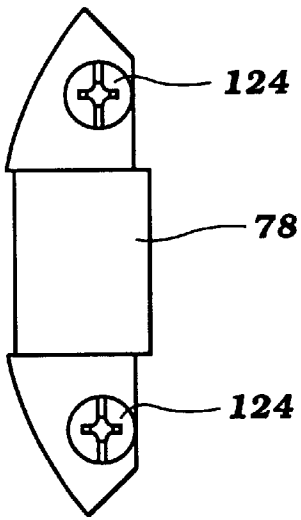
FIG. 7 is a plan view of a retaining member of a component of the ignition system in accordance with an embodiment of the invention.
Figure 6:
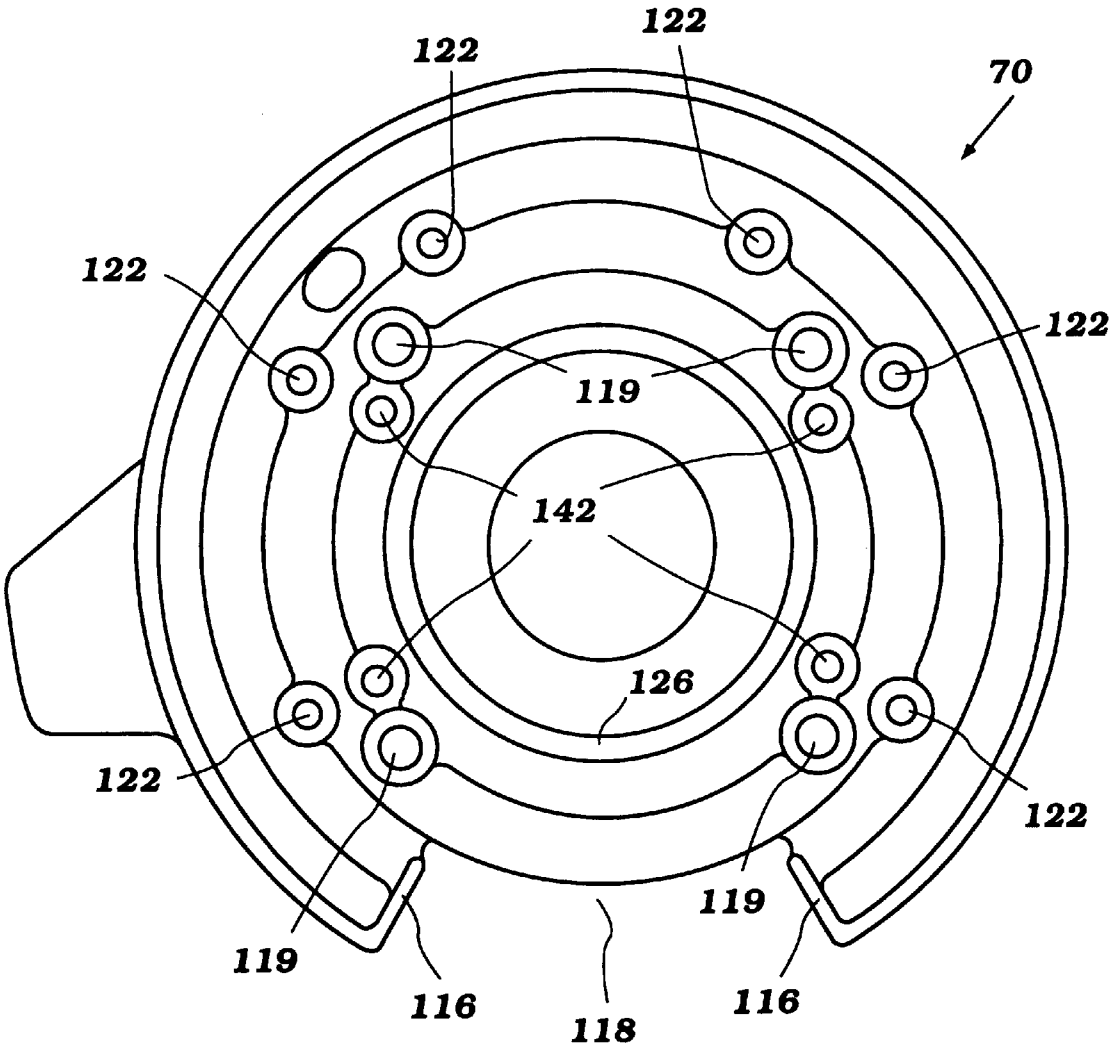
FIG. 6 is a plan view of an ignition member mounting structure in accordance with an embodiment of the invention.
Figure 9:
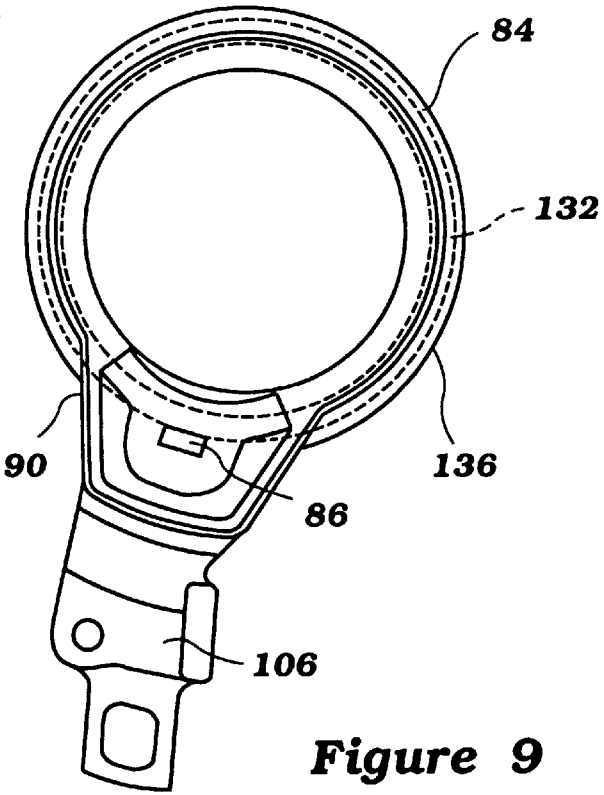
FIG. 9 is a plan view of the of pulser coil adjustment mounting member in accordance with an embodiment of the invention.
Figure 8:
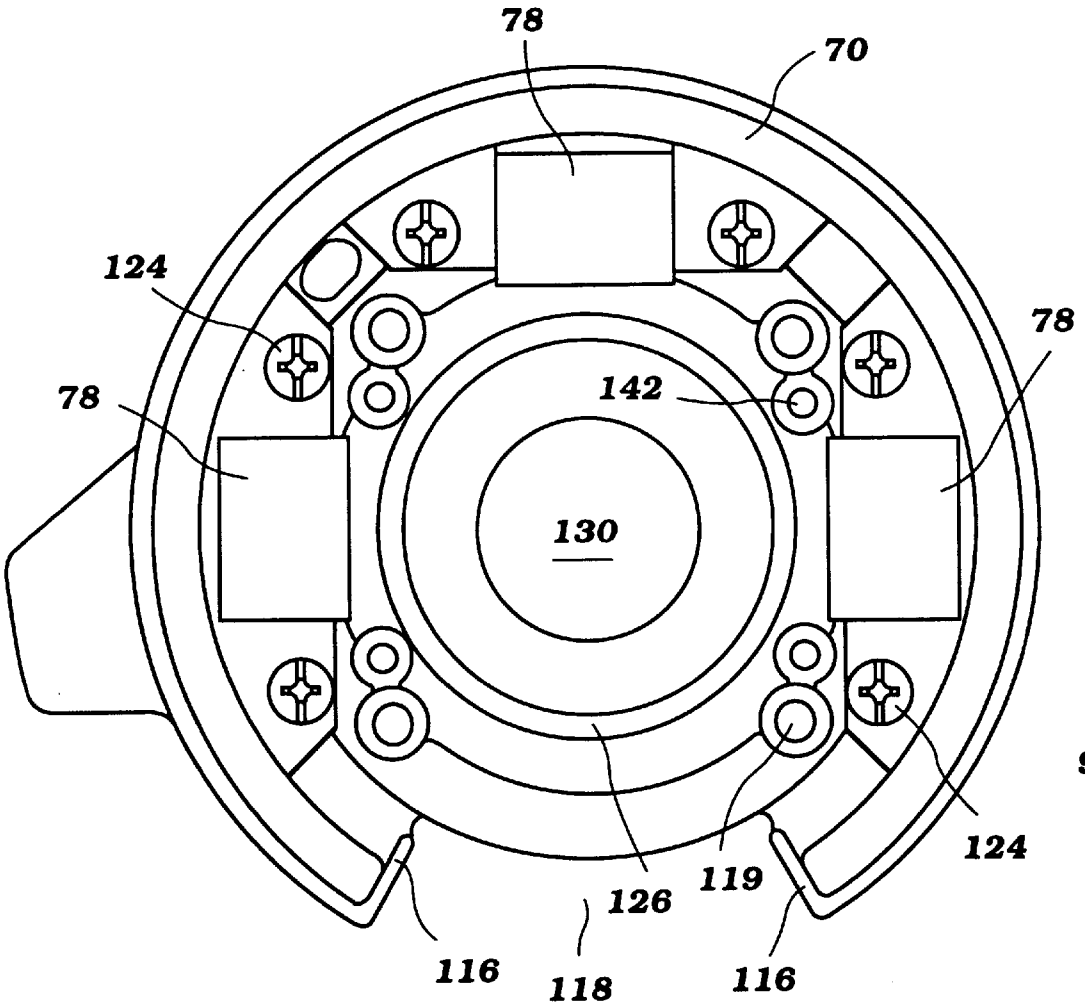
FIG. 8 is a plan view of an ignition member mounting structure with the retaining member of FIG. 7 mounted thereto.

The oil seal housing 70 also provides a location for the mounting of the charging coils 78. As best illustrated in FIG. 6 and FIG. 7, the oil seal housing 70 contains a plurality of internally threaded holes 122. The holes 122 mate with through holes in a corresponding charge coil retention brackets affixed to the charging coils 78. The charging coils 78 are secured to the oil seal housing 70 with threaded fasteners 124 which mate with holes 122.

The oil seal housing 70 also includes a groove 126 to support the rotation of the pulser mounting member 84. Preferably, the groove 126 is at least partially circular and at least partially surrounds the opening 130 through which the output shaft 24 extends. The pulser mounting member 84 preferably includes a ring protrusion 132 which mates with the groove 126 and allows for relative rotation of the member 84 with the oil seal housing 70. The pulser mounting member 84 preferably includes a shoulder 136 at least partially surrounding and encircling the member 84 for securing the member 84 to the oil seal housing 70. As best illustrated in FIG. 3, the shoulder 136 is trapped by retaining plate 138. The retaining plate 138 at least partially encircles the member 84 and is attached with threaded fasteners 140 which mate with threaded holes 142 in the oil seal housing 70 as best illustrated in FIG. 5.

Through the use of the oil sealing housing 70 to provide a mounting surface for the components of the ignition, the overall vertical height of the engine 14 is minimized. Further, the need for an additional ignition mounting piece is eliminated thereby decreasing the cost to manufacture the engine 14.

Of course, the foregoing description is that of preferred embodiments of the invention, and various changes and modifications may be made without departing from the spirit and scope of the invention, as defined by the appended claims.

What is claimed is:

1. An ignition arrangement for an internal combustion engine having an output shaft supported for rotation about an axis, an engine housing at least partially enclosing said output shaft, said engine housing having a recess in an outer face thereof receiving a bearing for journalling said output shaft, oil seal means positioned at least in part in said recess and at least partially surrounding said output shaft for sealing said output shaft and said bearing to said engine housing, an oil seal housing at least partially extending into said recess and surrounding said output shaft and at least partially engaging said oil seal means for retaining said oil seal in said recess, said oil seal housing directly supporting a first ignition component.

2. An ignition arrangement of claim 1 wherein said first ignition component is comprised of at least one charging coil.

3. An ignition arrangement of claim 1 wherein said oil seal housing further includes a groove at least partially encircling a side of said oil seal housing opposite the side engaging said oil seal means.

4. An ignition arrangement of claim 3 wherein said groove is at least partially circular.

5. An ignition arrangement of claim 4 further including a second ignition component mounting member rotatably mounted onto said oil seal housing on a side of said oil seal housing opposite said oil seal means.

6. An ignition arrangement of claim 5 further including at least one pulser coil mounted on said second ignition component mounting member.

7. An ignition arrangement of claim 1 further including a second ignition component mounting member rotatably mounted onto said oil seal housing on a side of said oil seal housing opposite said oil seal means.

8. An ignition arrangement of claim 7 further including at least one pulser coil mounted on said second ignition component mounting member.

* * * * *

UNITED STATES PATENT AND TRADEMARK OFFICE

CERTIFICATE OF CORRECTION

PATENT NO. : 6,053,155
DATED : April 25, 2000
INVENTOR(S) : Yukinori Kashima

It is certified that error appears in the above-identified patent and that said Letters Patent is hereby corrected as shown below:

Title page, Item [54] and Column 1, line 1,
Please correct Title: -- IGNITION MOUNTING ARRANGEMENT FOR AN OUTBOARD MOTOR --

Signed and Sealed this

Twenty-first Day of May, 2002

*Attest:*

*Attesting Officer*

JAMES E. ROGAN
*Director of the United States Patent and Trademark Office*